US010485300B2

(12) United States Patent
Flowers

(10) Patent No.: US 10,485,300 B2
(45) Date of Patent: Nov. 26, 2019

(54) SAFETY WOMEN'S HIGH HEEL SHOE

(71) Applicant: Claire Flowers LLC, St. Louis, MO (US)

(72) Inventor: Claire M. Flowers, St. Louis, MO (US)

(73) Assignee: Claire Flowers LLC, St. Louis, MO (US)

( * ) Notice: Subject to any disclaimer, the term of this patent is extended or adjusted under 35 U.S.C. 154(b) by 97 days.

(21) Appl. No.: 15/268,388

(22) Filed: Sep. 16, 2016

(65) Prior Publication Data

US 2017/0000215 A1 Jan. 5, 2017

Related U.S. Application Data

(63) Continuation of application No. 14/146,403, filed on Jan. 2, 2014, now abandoned, which is a continuation of application No. 29/472,829, filed on Nov. 15, 2013, now Pat. No. Des. 743,683.

(60) Provisional application No. 61/807,742, filed on Apr. 2, 2013.

(51) Int. Cl.

| | |
|---|---|
| ***A43B 21/24*** | (2006.01) |
| ***A43B 21/32*** | (2006.01) |
| ***A43B 7/14*** | (2006.01) |
| ***A43B 23/28*** | (2006.01) |
| ***A43B 13/22*** | (2006.01) |
| ***A43B 17/02*** | (2006.01) |
| ***A43B 21/02*** | (2006.01) |
| ***A43B 23/30*** | (2006.01) |

(52) U.S. Cl.

CPC ..... *A43B 21/32* (2013.01); *A43B 7/144* (2013.01); *A43B 7/145* (2013.01); *A43B 7/148* (2013.01); *A43B 7/1425* (2013.01); *A43B 7/1435* (2013.01); *A43B 7/1445* (2013.01); *A43B 13/223* (2013.01); *A43B 17/02* (2013.01); *A43B 21/02* (2013.01); *A43B 21/24* (2013.01); *A43B 23/28* (2013.01); *A43B 23/30* (2013.01)

(58) Field of Classification Search

CPC ..... A43B 21/32; A43B 21/02; A43B 21/24; A43B 7/1425; A43B 7/1435; A43B 7/144; A43B 7/1445; A43B 7/145; A43B 7/135

USPC ..... D2/966, 968

See application file for complete search history.

(56) References Cited

U.S. PATENT DOCUMENTS

| | | | | | |
|---|---|---|---|---|---|
| 1,411,264 | A | * | 4/1922 | Berger | A43B 13/34 36/34 A |
| D64,321 | S | | 3/1924 | Nutt | |
| 1,492,406 | A | | 4/1924 | Tobe | |
| D105,912 | S | | 8/1937 | Wolsky | |
| D112,337 | S | * | 11/1938 | Elkin | 36/34 R |
| D123,167 | S | * | 10/1940 | Nutt | D2/966 |
| D123,214 | S | * | 10/1940 | Nutt | D2/966 |
| 2,546,105 | A | | 3/1951 | McCarron | |
| D169,716 | S | | 5/1953 | Walsh | |
| 2,640,283 | A | | 6/1953 | McCord | |
| 2,852,864 | A | | 9/1958 | Quirk | |
| D186,842 | S | * | 12/1959 | Mehr | 36/34 R |

(Continued)

*Primary Examiner* — Jila M Mohandesi

(74) *Attorney, Agent, or Firm* — Sandberg Phoenix & von Gontard, P.C.

(57) ABSTRACT

A women's high heel shoe and method of manufacturing, the shoe having improved safety and usability features including an improved heal providing improved safety with a widened heel tip with improved traction and reduced surface penetration susceptibility while not detracting from the stylish narrowed high heel design of the shoe.

22 Claims, 7 Drawing Sheets

(56) References Cited

U.S. PATENT DOCUMENTS

| | | | | |
|---|---|---|---|---|
| D191,433 | S * | 10/1961 | Mehr | 36/34 R |
| 3,027,661 | A | 4/1962 | McCord | |
| 3,184,865 | A * | 5/1965 | Ronci | A43B 21/42 36/34 A |
| 3,200,518 | A * | 8/1965 | Rasmussen | A43B 21/24 36/34 R |
| 3,305,948 | A * | 2/1967 | Ronci | A43B 21/42 36/34 A |
| D278,094 | S | 3/1985 | Rousian | |
| 4,658,516 | A * | 4/1987 | Beck | A43B 13/16 12/142 RS |
| 4,922,629 | A | 5/1990 | Bouchet | |
| 5,133,138 | A | 7/1992 | Durcho | |
| 6,045,733 | A | 4/2000 | Chu et al. | |
| 6,389,712 | B1 * | 5/2002 | Schelling | A43B 13/122 36/103 |
| 6,571,491 | B2 | 6/2003 | Safdeye et al. | |
| 6,696,000 | B2 | 2/2004 | Otis et al. | |
| 6,698,109 | B2 | 3/2004 | Otis et al. | |
| 6,699,028 | B2 | 3/2004 | Davis et al. | |
| 6,745,469 | B1 | 6/2004 | Soik | |
| 6,761,845 | B2 | 7/2004 | Cheng | |
| 6,823,611 | B2 | 11/2004 | Otis et al. | |
| 6,944,975 | B2 | 9/2005 | Safdeye et al. | |
| 7,036,246 | B2 | 5/2006 | Otis et al. | |
| 7,179,414 | B2 | 2/2007 | Safdeye et al. | |
| 7,225,564 | B1 | 6/2007 | Gillespie | |
| 7,246,453 | B2 | 7/2007 | Kim | |
| 7,353,626 | B2 | 4/2008 | Otis et al. | |
| 7,621,058 | B2 | 11/2009 | Durand | |
| 7,690,132 | B2 | 4/2010 | Wlkenfeld | |
| 7,704,430 | B2 | 4/2010 | Johnson et al. | |
| 7,731,883 | B2 | 6/2010 | Johnson et al. | |
| D636,439 | S * | 4/2011 | Livingstone | D19/69 |
| 7,966,751 | B2 | 6/2011 | Durand | |
| D656,719 | S | 4/2012 | Morris | |
| 8,246,881 | B2 | 8/2012 | Maranan et al. | |
| 8,464,383 | B2 | 6/2013 | Sing | |
| D716,031 | S * | 10/2014 | Wang | D2/965 |
| 2003/0009919 | A1 * | 1/2003 | Stein | A43B 3/108 36/59 R |

* cited by examiner

SECTION A-A

SECTION A-A

SECTION A-A

SECTION B-B

SECTION X-X

SECTION X-X

SAFETY WOMEN'S HIGH HEEL SHOE

CROSS-REFERENCE TO RELATED APPLICATIONS

The application is a continuation application of U.S. patent application Ser. No. 14/146,403, filed on Jan. 2, 2014, that claimed the benefit of U.S. Provisional Application No. 61/807,742, filed Apr. 2, 2013, as well as U.S. Design patent application No. 29/472,829, filed Nov. 15, 2013 (now U.S. D743,683). The disclosures of these applications are incorporated herein by reference.

FIELD

The present disclosure relates to man-made shoes and, more specifically, to man-made women's high heel shoes having anti-slip, anti-abrasion and/or anti-catch soles and heels.

BACKGROUND

The statements in this section merely provide background information related to the present disclosure and may not constitute prior art.

Although athletic and some casual shoes have had patterned soles and/or extended structures on such soles for improved traction on varying surfaces, many dress shoes including women's high heel shoes. High-heeled footwear is footwear that raises the heel of the wearer's foot significantly higher than the toes. High heels tend to give the aesthetic illusion of longer, more slender legs, which are attractive feminine features and serve as a status symbol. Many industry experts consider high heels as heels ranging from 2 inches to 5 inches in height, though these are unscientific measurements. These high fashion women's high heel shoes traditionally have smooth soles. This is true of both natural leather soles, as well as synthetic soles such as those of suede, rubber or sueded-rubber. Such soles do not necessarily offer optimum traction and on certain surfaces such as wet surfaces, wearers of such dress shoes having such soles often encounter slipping on smooth, wet or slippery surfaces. As such, these shoes are fashionable and provide an aesthetic benefit to the wearer, there are a number of reasons the women often chose not to wear such shoes on certain occasions. These include situations where they may not be practical or where a safety issue may be present. In certain situations, the wearer of high heels may be vulnerable to injury due to unstable ground, slick or wet surfaces, surfaces that include cracks or holes or other types of terrain such as when exposed to common hazards such as metal grates, drains, hole-covered sidewalks, decks having spaced apart wood planks, and/or cracked surfaces. For example, they are often not easily, comfortably or safely worn on any non-hardened surface. Wearers of existing high heel shoes have gotten their heels stuck in various cracks and holes or penetrable surfaces with the result being a loss of footing and potential falls.

Thus, an invention that allows for greater stability with high heels, in addition to anti-slip and anti-abrasion utility would provide significant benefits to consumers and wearers of high heels. The prior art related to various efforts have included adding on an outer extendable layer, cutting an opening in a shoe sole, particularly a leather shoe sole, for the affixing of a rubber insert with a glue or adhesive compound so that the rubber insert protrudes beyond the surface of the sole to provide additional traction. Further, this can also be performed through automated molding of a synthetic sole having the anti-skid insert provided without having to cut an opening in the sole. In such prior art, molds are provided accepting different materials in one or two molding steps for providing an insert of portion of the sole having a higher surface friction than other portions of the sole being molded.

Furthermore, such existing inserts may be viewed as being stylish for athletic shows, but are not view as being desirable from a visual perspective for shows of high style such s women's high heel shoes.

Further, women's high heel shoes have a high or elevated shoe heel that extends downward either towards a heel end or heal tip or cap having a sole portion for the heel that is often significantly narrowed (referred to as a stiletto heal) or relative straight or is a bulky heal (referred to as a chunky heal). While stylish, these elongated heels often cause the wearer to get their heels caught in various manners such as in holes or grates or cracks on the walking surface such as iron grates, and cracks in wood floors, by ways of example. Further, the heels and therefore the shoes are often restrictive as to the surface upon which they can be comfortably and safely worn. However, the production of such soles is relatively time-consuming and labor-intensive as compared to the production of smooth soles and are not often used in women's high heel shoes as they are viewed has detracting from the fashionable image of the shoe.

The inventor hereof has created improvements to the design of women's high heel shoes to address these limitations in the prior art while still maintaining the high heel shoe as fashionable and stylish footwear.

SUMMARY

The inventor hereof has succeeded at designing a high heel shoe assembly that allows for greater stability with high heels, in addition to anti-slip and anti-abrasion utility would provide significant benefits to consumers and wearers of high heels. This can include, in some embodiments a high heel shoe with a man-made sole and heel for a woman's high heel show that are stylish as well as having improved traction and that are more comfortable and safe for wearing on walking surfaces having holes, cracks or that are penetrable.

According to yet another aspect, a heel for a women's high heel shoe includes a heel main body having a proximal end defining an upper attachment portion, a heel distal end and a heel shank defined there between. The proximal end can be configured for attachment to a heel portion of a shoe sole base and has a widened dimension corresponding to an outer periphery thereof. The distal end has an outer periphery with an outer dimension that in some embodiments is between about 0.9 and about 1.25 inches, and in one embodiment is one inch. The heel shank or middle portion of the heel has a comparatively narrowed neck portion with an outer dimension that is less than the outer dimension of the distal end or proximate end. In some embodiments the heel shank has an outer dimension that is visibly less that the outer dimension of the distal end and is between 0.25 and 0.40 inches, and in one embodiment is between about 0.3 and about 0.36 inches.

According to still another aspect, s women's high heel shoe comprising a shoe sole base having a front, a middle and a back and a top surface and a bottom surface, the sole base includes a lower sole positioned at the front for supporting a ball and toes of a wearer of the high heel shoe with an upper sole positioned at the back for supporting the heel of the wearer and for supporting a heel of the shoe, and a shank sole defined in the middle between the lower sole and the upper sole, the base having an outer perimeter defining a shape of the sole base and an exposed sidewall thereof, the sole being composed of a sole base material. The shoe also including a heel main body having a proximal end defining an upper attachment portion, a heel distal end and a heel shank defined there between, the proximal end configured for attachment to the upper sole of the base and having a wide dimension corresponding to an outer periphery thereof, the distal end having an outer periphery with an outer dimension between about 0.9 and about 1.25 inches and the heel shank having a narrowed neck portion with an outer dimension being comparatively less than the outer dimension of the distal end and between 0.25 and 0.40 inches.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

It should be understood that throughout the drawings, corresponding reference numerals indicate like or corresponding parts and features.

DETAILED DESCRIPTION

Figure 1:
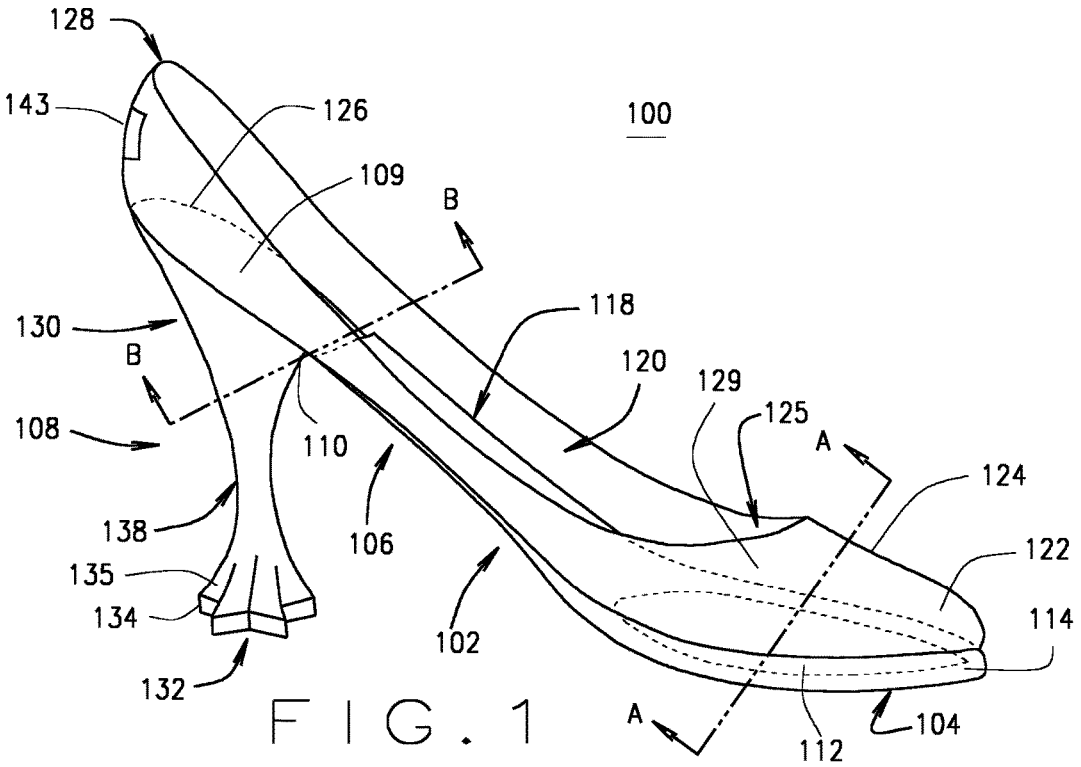
FIG. 1 is a side isometric view of a shoe assembly according to one exemplary embodiment.

The following description is merely exemplary in nature and is not intended to limit the present disclosure or the disclosure's applications or uses.

In some embodiment, a sole for a women's high heel shoe includes a sole base, a cavity and an insert. The sole base has a front, middle and back as oriented from the front or toes of a foot backward towards the heel. The front includes a lower sole positioned at a front of the shoe for supporting a ball and toes of a wearer of the high heel shoe. The upper sole is positioned at a back of the shoe for supporting the heel of the wearer. The back of the sole provides for attaching or having an integrated high heel of the shoe. The sole includes a sole shank defined between the lower sole and the upper sole. The sole base can be formed of a sole base material that can be any suitable material and in some embodiments is leather or can be a man-made material composition such as a polymer or rubber, by way of example. The sole base has an outer perimeter defining the shape of the sole and therefore the shoe. The outer perimeter, in that that the sole base has a width between a top surface and an bottom surface, defines an exposed sidewall for each of the upper sole, the shank sole and the lower sole.

The sole includes a cavity that is formed or cut or otherwise created in the lower sole of the sole base for receiving an insert. The cavity and the insert are formed to have similar or matching outer shapes so that the insert fits within the cavity. The cavity further can be shaped to conform to the shape of the lower sole such as that portion below the ball of the foot or the ball and toes of the foot of the wearer. The cavity has a cavity perimeter that is set back or spaced apart inwardly from the outer perimeter defining the lower sole and defines an outsole between the perimeter of the cavity and the perimeter of the sole base at the side wall, e.g., the outsole as defined herein is the portion of the sole base between the defined cavity and any insert positioned therein and the outer perimeter defining the side wall of the sole base.

The cavity defines a raised cavity wall within the body of the sole base that is about a perimeter of the cavity. The insert is dimensioned and formed to be positioned in the cavity and coupled or otherwise fixedly positioned within the cavity of the sole base. The insert has an insert shape defined by a periphery that is substantially the same as the shape of the cavity, but can have a thickness or depth from the bottom contacting surface to the top surface which is inserted first into the cavity. The insert has an outer edge, a top surface that is inserted first into the cavity and a bottom surface that includes one or more anti-skid features thereon for providing an increased friction against the walking surface. To further aid in a slip resistant use, the insert is composed of an insert material selected from a material having anti-skid characteristics in addition to the one or more anti-skid features. As such, the insert is composed of a material that is different that the material of the sole base.

The insert is positioned in the cavity of the lower sole base for providing an improved anti-skid surface for contacting the walking surface. The insert is further dimensioned to make contact with the walking surface and in some embodiments has a portion that extends downward towards the walking surface and extends out of the cavity and beyond the bottom surface of the sole base.

The cavity and insert arrangements can vary and can be of any shape or arrangement and can be configured in any suitable manner for securing the insert into and/or within the cavity. This can include securement or attachment of the insert to the sole base or to another component of the shoe such as a mid-sole positioned above the top surface of the sole base, or to the insole in some embodiments. The insert can be coupled to the sole base or to the mid-sole by an adhesive, or by sewing.

In one embodiment, the cavity in the sole base formed to include a groove along at least a portion of the raised cavity wall between the top surface of the sole body and spaced apart from the bottom surface of the sole. In other embodiments, rather than a groove, the cavity wall can be inwardly sloped or curved or shaped for engagement with the outer periphery of the insert for coupling thereto. Where a groove is formed in the cavity wall, the insert can include a protrusion about all or a portion of the periphery of the insert that corresponds to a mating portion of the raised cavity wall having the groove formed therein. In this manner, the mating of the insert into the groove can provide for at least a portion of the securement of the insert. The insert can be coupled to the sole base material at least in part by placement of the protrusion of the insert into the corresponding groove of the raised cavity wall and an adhesive can be added to one or both.

The cavity as described can be a cavity that is only a partial cavity in the sole base that defines a cavity surface that is a predefined depth from an outer or bottom surface of the sole base, defined from the bottom sole surface down by the cavity wall to a bottom cavity surface. In other embodiments, the cavity can be a through hole in the sole base.

In the embodiments where the cavity is only a partial cavity having a cavity bottom surface, the insert can be coupled to the sole base by an adhesive that can be placed between the upper surface of the insert and/or the bottom cavity surface of the sole base prior to placement of the insert within the cavity. This can be in additional to any adhesive around the cavity wall or the interlocking of the sidewalls with the edges or formations thereon of the insert, such as the groove and protrusion or sloped or curved or otherwise mating wall surfaces as described above.

In another embodiment, a method of making a lower sole for a women's high heel shoe includes providing a shoe sole base that includes a lower sole positioned at a front for supporting a ball and toes of a wearer of the high heel shoe and an upper sole position at a back for supporting the heel of the wearer and for attaching a heel of the shoe and a shank sole defined between the lower sole and the upper sole. The base, cavity and insert are as described above. The method of making can include forming the sole base and creating a cavity in the lower sole base having a shape that conforms to a shape of the lower sole. This creating can be by cutting, molding, shaping or other suitable means. When leather is used as the sole base, cutting or pressing may be used. Where a molded sole base is used, the cavity can be formed during the sole base molding process. The created cavity has the cavity perimeter that is set back from the outer perimeter defining the lower sole and defining an outsole there between and defines a raised cavity wall about a perimeter of the cavity. The insert is created by cutting or molding to have an insert shape defined by a periphery that is substantially the same as the shape of the cavity. The insert is created to have an outer edge, a top surface and a bottom surface, the bottom surface including one or more anti-skid features. As noted above, the insert can be composed of an insert material selected from a material having anti-skid characteristics and being different than the sole material. The next step is the inserting of the insert into the cavity and the coupling of the insert within the cavity or to the sole or to a mid-sole base or inner sole or other component of the shoe. This coupling secures the insert within the cavity to become an integral and fixed part of the shoe sole.

The creation of the shoe sole and the cavity can be performed in a single molding process where a non-leather sole base is utilized. The mold can be filled with different compositions for the sole base with the outsole as compared to the composition material for the insert. The insert can be formed to include one or more or in many embodiments a plurality of anti-skid features on the bottom of the surface of the insert using a molding process. These can include an anti-skid patter of protruding features. The insert can also be made not of a single composition but of more than one composition such that certain of the anti-skid features are composed of a material having a different, such as increased, friction or softness or pliability, as compared to other features of the insert.

As noted above, the method can include forming a groove or other feature or shape of at least a portion of the cavity wall that is between the outer surface of the sole body and spaced apart from the bottom surface of the cavity. This can include creating a groove along the wall either between the top and bottom of the wall or can be a groove or notched formation at the bottom of the wall adjacent to the bottom surface of the cavity. Similarly, the creation of the insert can include making a mating component to the wall formation or feature such as forming a protrusion about all or a portion of the periphery of the insert corresponding to a mating portion of the raised cavity wall having the groove formed therein. In such embodiments, the process of coupling includes placing the protrusion of insert into the corresponding groove of the raised cavity wall. This can also include in some embodiments, applying an adhesive to at least one of the groove and the protrusion prior to the placing of the protrusion into the groove. Where a through cavity is not created, this can also include coupling the upper surface of the insert to the bottom cavity surface of the sole such as be applying an adhesive.

Wherein the cavity is a through cavity extending between the bottom sole base surface and the top sole base surface, the cavity wall mating features can also be formed and coupled as described above. However, in such embodiments, the top surface of the insert cannot be secured to the bottom of the cavity surface as it is a through cavity. However, the insert can be secured such as by an adhesive to a mid-sole or inner sole component of the shoe.

In some embodiments, an assembly of a women's high heel shoe includes a heel. The heel includes a main heel body having a proximal end defining an upper attachment portion for attaching to the sole base or other component forming the sole of the shoe directly supporting the foot of the wearer. In some embodiments, the proximal end can be integrally formed with the heel sole base. Below the heel proximal end is a middle portion of middle or shank of the heel. This portion extends downward from the proximal end and the wide area of the sole base associated therewith, and significantly narrows to have a narrowed cross-sectional area near the center or at a narrowed portion. From there, the heel widens downward to a heel distal end that can include a heel tip or cap for contacting the walking surface. As noted the proximal end and the distal end are wider than the heel shank which is in the middle defined there between. The proximal end can have a width of the bottom of a women's heel that can range, by way of example, between about 1.375 to about 1.75 inches, or could be more or less. In contrast, the width of the cross-sectional area of the shank or narrowest portion of the heel, at least as viewed from the rear of the shoe, can range between about 0.25 and about 0.14 inches, by way of example. This can include in some embodiments, a shank width of between about 0.3 and about 0.4 inches and in one embodiment is about 0.31 inches and in another embodiment is about 0.36 inches. The shape of the shank can be of any cross-sectional shape including a circle, an oval, a parallelogram, or otherwise.

The widened distal end can have a range of cross sectional widths of between about 0.8 inches to about 1.25 inches and in one embodiment is about 0.89 inches, in a second embodiment is about 0.99 inches and in another embodiment is about 1.0 inches. The widened distal end provides the heel tip that is considerably wider than the shank width, but that provides a stable and widened heel tip that contacts the walking surface. While the shank of the heel provides the thin and desirable narrowed shape of a stylish high heel of between 2 and 3 or more inches, the widened distal end provides a heel tip that can prevent the heel from getting caught in holes, slots or soft walking surfaces.

In some embodiments, the heel having the combination of widths as described above is considered to have a substantially narrowed neck or shank portion with an outer dimension substantially less than the outer dimension of the distal end. This substantial difference or comparative difference in the widths is relative to the dimensions typically used for a high heel shoe as known to one of skill in the art and is not orders of magnitude but comparative visually substantially different. The selection of the combinations of the various sizes allows for designers of shoes to design shoes with high heels, but that provide for the safe utilitarian aspects of the widened heel tip in a stylistic manner.

Further, the distal end can include a heel tip with a surface contact portion coupled to the distal end that is composed of a non-skid material. This can include a single material, a material that is similar to that of the insert, multiple materials or compositions having different frictional characteristics, or can include on or more anti-skid features such as patterns.

The distal end can be formed to have any shape that may be desirable by the design of the shoe, such as a polygon, a regular convex polygon, an equiangular polygon, circle, an oval, a star shape, flower shape, and any such with rounded corners or other features. Whatever shape is chosen, the width, cross sectional area and shape is preferred to limit any retention of the distal end in a hole or crack or would otherwise catch or restrain the heel tip in a feature of the walking surface.

In some embodiments, the upper sole and lower sole of the shoe are one continuous piece. The shell of the shoe may have a cavity where the ball of the foot and toes would be so that the sole then protrudes through that hole and is stabilized. The sole's construction offers comfort for the foot and the anti-slip element, adding general stability with each stride. The sole may be lined with padding and covered so that the appearance of the inside of the shoe is not that of tire tread but more in-line with the outside aesthetic of the shoe for visual purposes. Additional anti-abrasion features may be added to the footwear, including but not limited to, steel-toed or steel-rimmed parts of the footwear, weatherproof materials, or cushion-like components that reduce normal wear and tear.

Referring now to the exemplary embodiments as shown in the drawings, FIG. 1 illustrates a women's high heel shoe 100 includes a sole 102 having a front portion 104 (associated with the toes and a least a portion of the vamp), a shank portion 106 (associated with the instep) and a rear or back portion 109 (associated with a heel), that later of which forms the back edge 126. The shoe upper 120 includes a front portion 129 that has an upper vamp portion 124 (referred herein as vamp 124) that defines a toe cavity 125 with a front or toe tip 122. The shoe upper 120 also has a mid-portion and a heel portion 128. An insole 118 is positioned on a top surface of the sole 102 within the shoe upper 120 for providing a cushioned material and/or a support layer for the wearer's foot.

Figure 2:
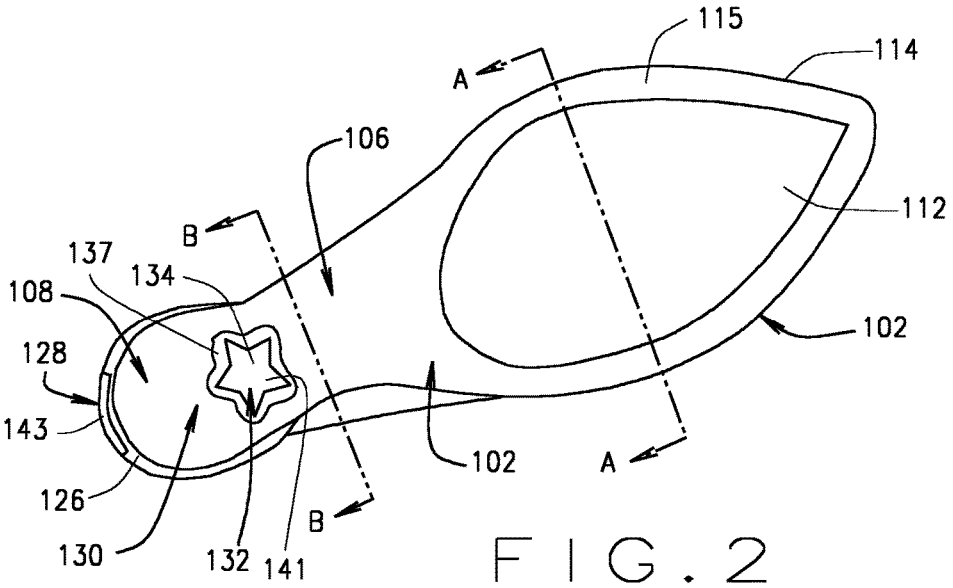
FIG. 2 is a bottom view of the shoe according to one exemplary implementation of the shoe shown in FIG. 1.

The sole 102 defines an outer sole periphery defined by an exposed side wall 114. As shown in FIGS. 1 and 2, the front portion 104 of the sole 102 that is proximate to and below the portion where the ball of the foot is located within the shoe 100 includes an anti-skid insert 112 on the bottom surface thereof that includes one or more anti-skid features (not shown) that can be a pattern or a plurality of raised anti-skid protrusions of features arranged on or about the bottom surface of insert 112. The insert is formed within the front portion 104 while retaining a portion of the sole base 102 so that an outsole 115 is formed between the side wall 114 and the insert 112.

The shoe 100 also includes heel 108 that is formed with the sole 102 or attached thereto during assembly. The heel 108 typically intersects with the sole 102 at a heel to sole intersection 110 at which the proximal end 130 is attached or coupled or integrally formed with the sole base 102. The proximal end is directly below and supports the back portion 109 and has a width that is associated with the width of the back portion 109 or can be narrower. The heel 108 then narrows downwardly to a shank portion 138 in the middle of the high heel 108 as described above. From this narrowed shank portion, the closer to the heel tip 134, the width of the heel 108 widens to form the widened distal end 135 of the heel. The distal end 135 can also be configured with an attached or integrally formed heel tip 134. The heel tip 134 (also referred often as the top lift, the heel tip, heel cap and/or the top piece) can be made of a non-skid material. This can include one or more materials or formations such as shown in FIG. 2. As shown here, the distal heel end 132 includes a widened distal end 135 with a heel tip 134. As shown the heel tip 134 includes an outer portion 137 and an inner portion 141. The inner portion 141 can be made of a material that has improved traction or non-skid characteristics but can also be shaped to have a style or trademark appearance.

The shoe 100 of FIGS. 1 and 2 also includes a heel plate 143 positioned on the heel portion 128 at the rear of the shoe. This heel plate 143 can provide protection for the heel of the shoe such as when the wearer is driving a car or sitting or against other scuffs to the rear of the shoe as are currently common among such shoes. Further, the heel plate 143 can include a trademark or other indicator (not shown).

FIGS. 3A-C, 4A-C and 5A-C are each are cross-sectional views of section A-A of FIGS. 1 and 2 illustrating three exemplary embodiments of the formation of the sole base 102. Each "A" figure illustrates the shoe 100 with the vamp 124 and toe cavity 125 and inner sole 118 positioned on the sole base 102.

Figure 3A:
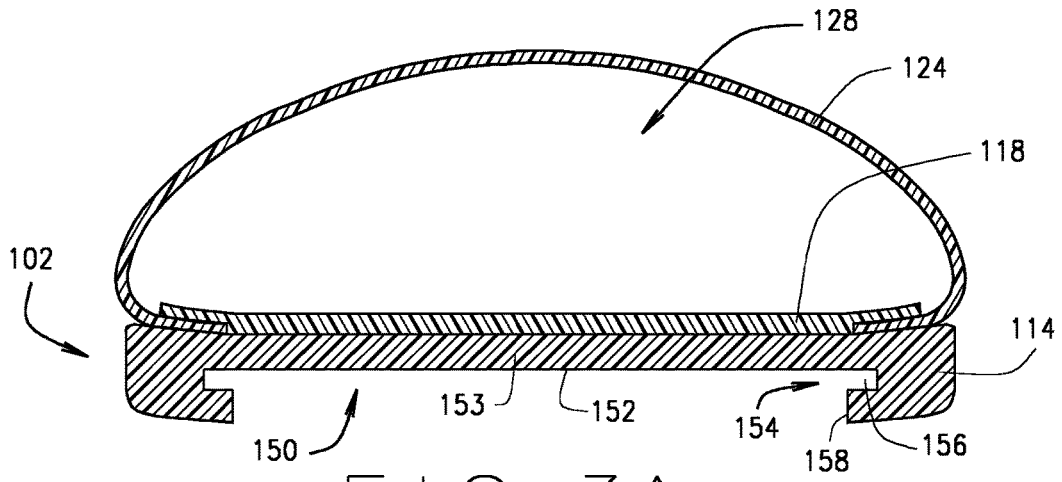
FIGS. 3A-3C are cut away cross-sectional views of a ball area of a shoe sole assembly along Section A-A according to a first exemplary embodiment.
Figure 3B:
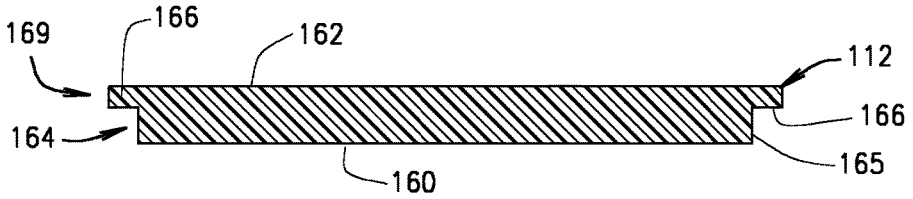
Figure 3C:
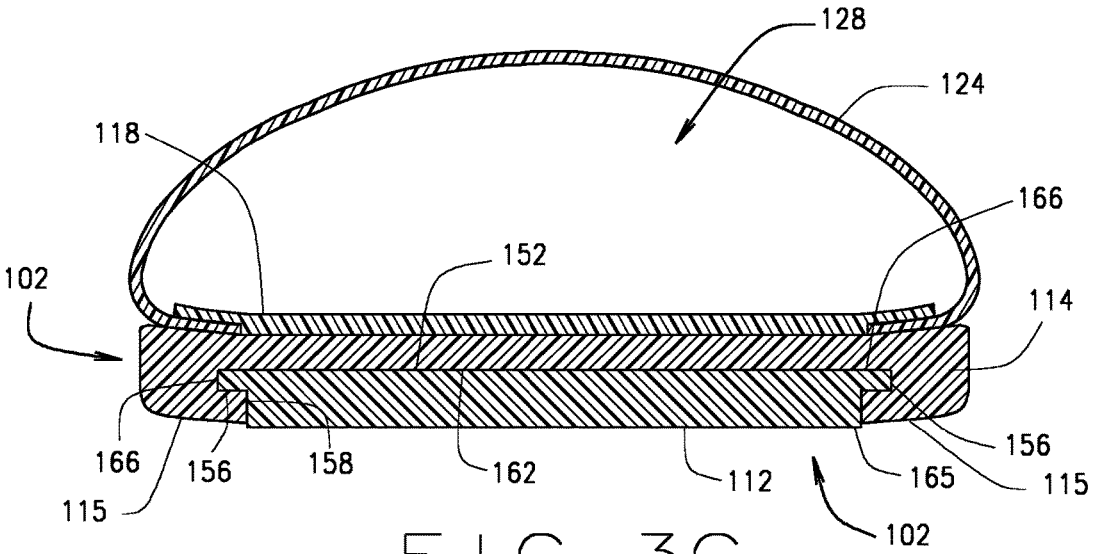

FIGS. 3A-C illustrate a first embodiment for the formation of the cavity 150 and insert 112. In FIG. 3A, the cavity 150 is formed in the sole base 102 with cavity wall 154 being spaced from the exposed side wall 114 to form an outsole 115. The cavity 150 is not a through cavity includes a sole back layer 153 extending from side to side to form the cavity back surface 152. As shown in this example, the cavity wall 154 includes a groove 156 positioned adjacent to the back surface 152 thereby forming a cavity lip 158 adjacent to the outsole 115 and the bottom surface of the sole 102. FIG. 3B illustrates a mating insert 112 that includes insert side edge or side wall 169 that has a protrusion 166 dimension for mating with the cavity groove 156. The insert side wall 169 extends downward from the protrusion 166 with wall extension 164 that conforms to the cavity lip 158 of the cavity wall 154. The shape and dimensions of the insert side wall 169 corresponds with the shape and dimensions of the cavity wall 154 for insertion of the insert 112 therein as shown in FIG. 3C in an illustration of the assembled sole 102.

Figure 4A:
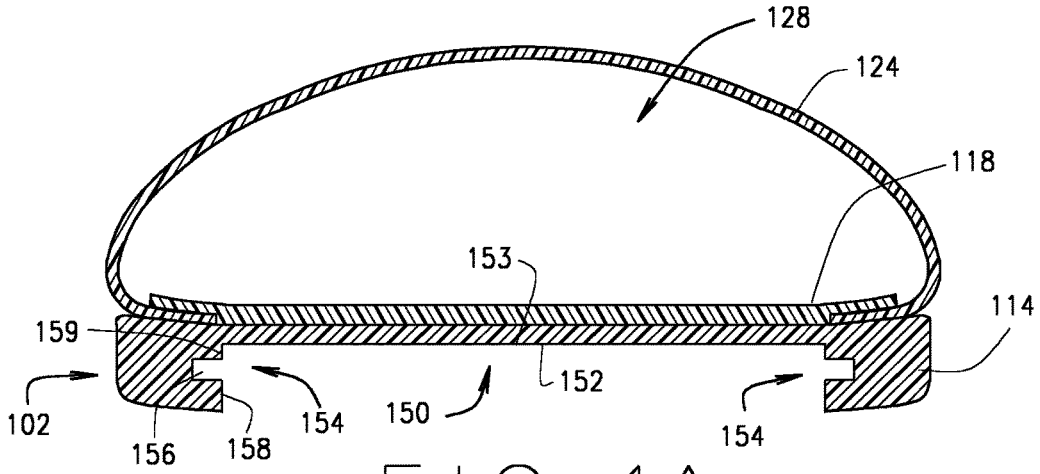
FIGS. 4A-4C are cut away cross-sectional views of a ball area of a shoe sole assembly along Section A-A according to a second exemplary embodiment.
Figure 4B:
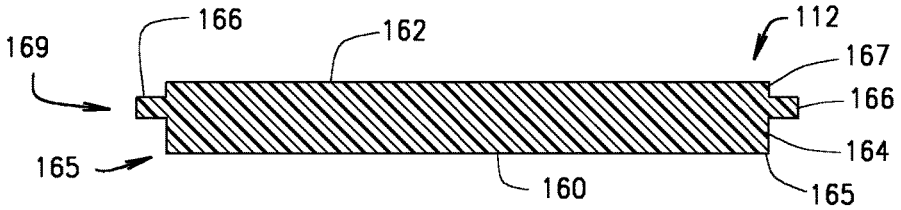
Figure 4C:
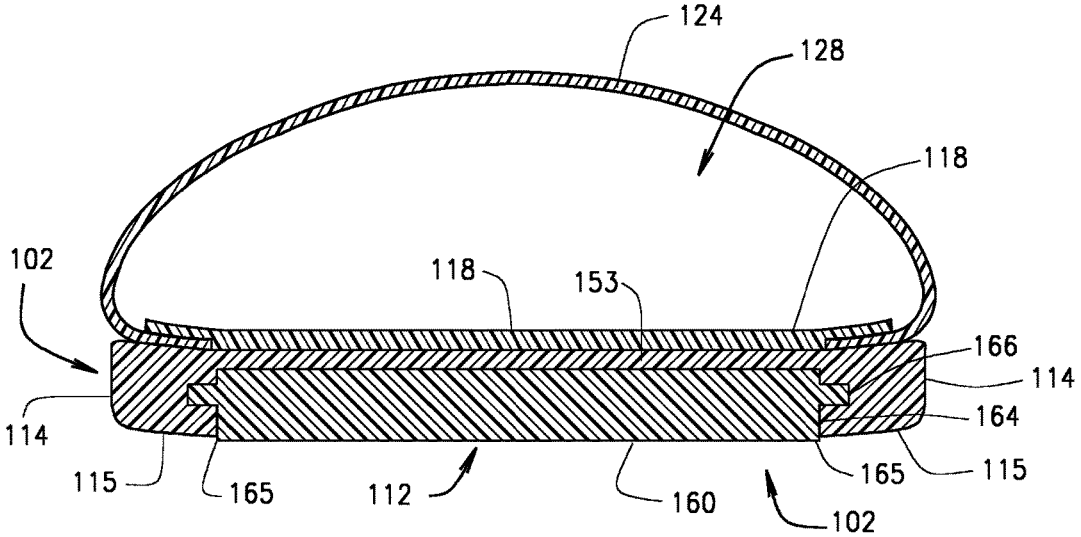

FIGS. 4A-C similarly illustrates a second embodiment for the formation of the cavity 150 and insert 112. In FIG. 4A, the cavity 150 is formed in the sole base 102 with cavity wall 154 being spaced from the exposed side wall 114 to form an outsole 115. The cavity 150 is also not a through cavity includes a sole back layer 153 extending from side to side to form the cavity back surface 152. As shown in this example, the cavity wall 154 includes a groove 156 but in this embodiment, the groove 156 is positioned mid-way between the cavity back surface 152 and the bottom surface as defined by the outsole 115. In this case, the cavity wall 154 includes a back cavity lip 159 that is adjacent to the back surface 152 that then forms the groove 156 and a front cavity lip 158 that is adjacent to the outsole 115 and the bottom surface of the sole 102. FIG. 4B illustrates a mating insert 112 that includes insert side wall 169 that has a protrusion 166 dimension for mating with the cavity groove 156, and an inner side wall portion 167 that conforms to the back lip 159 for full insertion into the cavity 150. The protrusion 166 conforms to the groove 156 and the outer wall extension 164 conforms to the cavity lip 158 of the cavity wall 169. The shape and dimensions of the insert side wall 166 corresponds with the shape and dimensions of the cavity wall 154 for insertion of the insert 112 therein as shown in FIG. 3C in an illustration of the assembled sole 102.

Figure 5A:
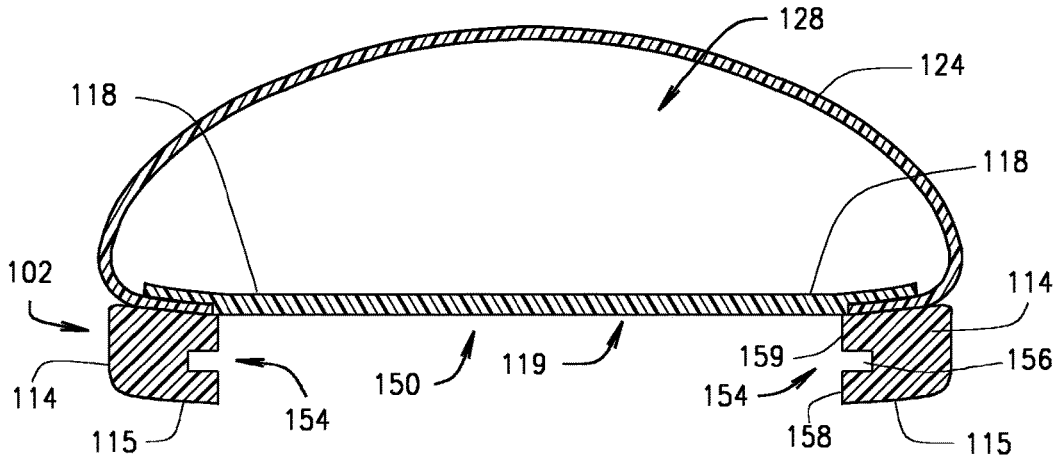
FIGS. 5A-5C are cut away cross-sectional views of a ball area of a shoe sole assembly along Section A-A according to a third exemplary embodiment.
Figure 5B:
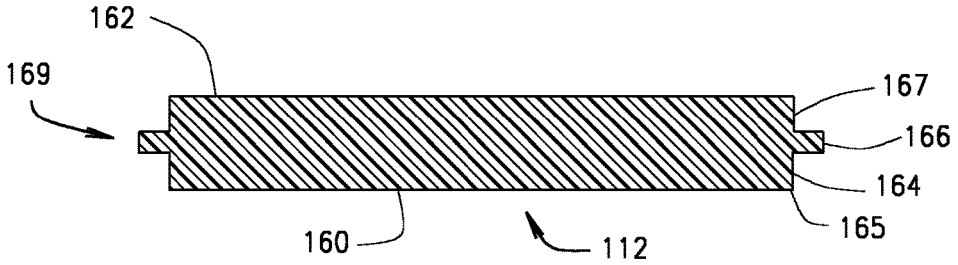
Figure 5C:
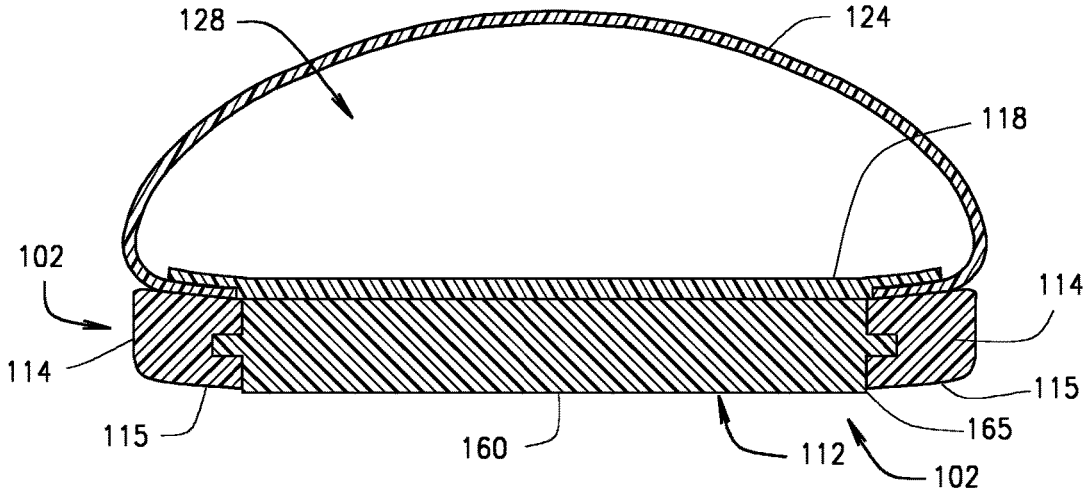

FIGS. 5A-C similarly illustrates a third embodiment for the formation of the cavity 150 and insert 112, but in this embodiment the cavity in the sole 102 is a through cavity 150. As shown in FIG. 5A, the cavity 150 is formed in the sole base 102 so that the sole has the two out soles 115 separated and not coupled at cross-section A-A of the sole 102. In this embodiment, the cavity wall 154 and insert 112 are similarly formed to that shown in FIG. 4A-4C but without the back portion 153 and therefore without the back surface 152. As shown in FIG. 5C, the insert 112 is dimensioned so that the insole 118 (or a mid-sole not shown) is engaged with the back or top surface 162 of the insert 112.

As shown in each of these embodiments, the insert 112 is also dimensioned to have a downward extending portion 165 that extends downward towards the walking surface as compared to the out sole 115 or other portions of the sole 102. The extended portion 165 of the side wall 169 of the insert 112 can be the entire cross sectional area of the insert 112 or only portions of the insert 112 such as one or more of the non-skid features or portions of the bottom surface of the insert 112. The extent of the downward extending distance of the downward extending portion 165 of all or a portion of the insert 112 or any non-skid feature thereof provides for contact of the non-skid insert 112 on the walking surface during normal use of the shoe 100 to provide the non-skid feature thereof. While FIGS. 3C, 4C, and 5C all illustrate that the downward extending portion 165 is a slight downward extended distance, this dimension can be greater or less than illustrated as these drawings are only exemplary and art not to scale. In some embodiments, this downward extending portion 165 is only slight as shown so that the general appearance of the high heel shoe 100 does not change from that of other high heel shoes, e.g., the general observer would not see the insert 112 nor the downward extending portion 165 but would generally only see the side wall 114 of the sole 102. In other embodiments, the amount of downward extension of downward extending portion 165 can be increased.

Further, while not shown, but as disclosed above, an adhesive can be used to couple and secure the insert 112 within the cavity 150 either between the cavity walls 154 and the insert side walls 169 or the back surface 162 of the insert either the bottom surface 152 of the cavity 150 or the bottom surface 119 of the insole 118. The adhesive is not shown in these figures but will be understood to one of ordinary skill in the art.

Figure 6A:
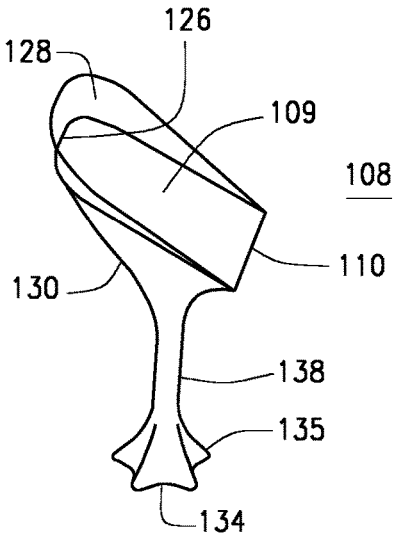
FIGS. 6A-6F are illustrations of a heel for a women's shoe having a widened star-shaped heel tip according to some exemplary embodiments.
Figure 6B:
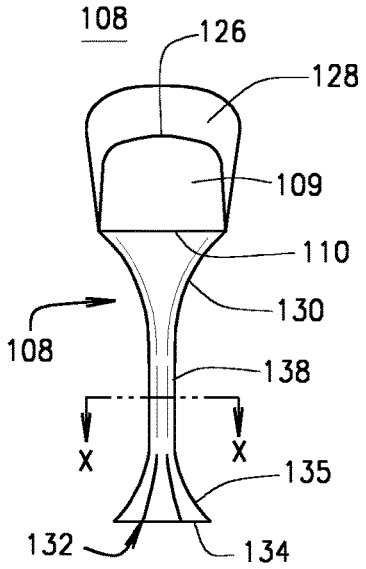
Figure 6C:
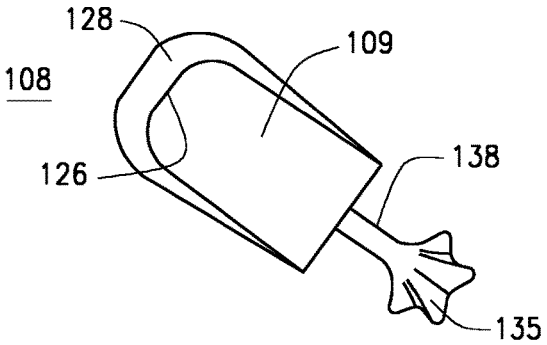
Figure 6D:
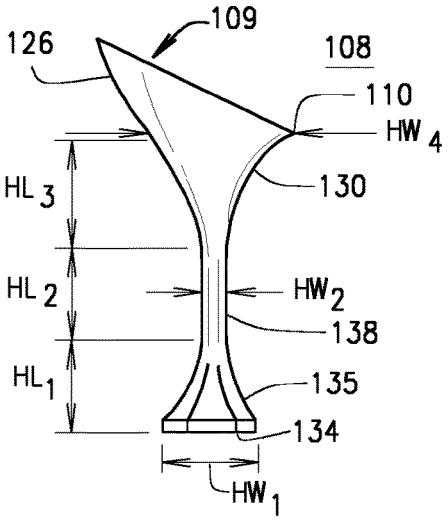

Referring now to the heel 108 as discussed above, FIGS. 6A-6F illustrate various aspects and features. FIG. 6A is a side perspective view; FIG. 6B is a front perspective view; FIG. 6C is a top perspective view; FIG. 6D is a right side view; and FIG. 6E is a bottom view of a heel 108 that is separated from the shoe sole 102 and other components of the shoe 100 for illustration of the specific components thereof. As shown, heel 108 for a high heel shoe is between about 2 inches and about 5 inches in height. The heel 108 includes a top or proximal end 130 which is widened for coupling to or association with the back portion 109 of the sole 102.

The back edge 126 of the proximal end 130 can be formed with the back edge 126 of the sole 102. The front edge of the proximal end is defined by the demarcation edge 110. As addressed above, the heel width of the proximal end $HW_3$ of the heel 108 can range depending on the size of the shoe as well as the design of the shoe, but $HW_4$ often ranges between about 1.375 to about 1.75 inches. The length proximal end $HW_4$ as shown in FIG. 6D can also have similar sizing or can be adjusted for the particular implementation.

The heel 108 extends downward a distance of $HL_3$ from the proximal end 130 to a narrowed shank portion 138. The width $HW_2$ of the shank portion 138 is significantly narrowed as compared to the wide of the proximal end 130 and $HW_2$ typically ranges between about 0.3 and about 0.4 inches and in one embodiment is about 0.31 inches and in another embodiment is about 0.36 inches. The length $HL_2$ of the shank portion 138 will vary depending on the overall height of the heel. The heel 108 has a lower portion referred herein as the distal end 135 that has a length of $HL_1$. The distal end 135 defines a distal heel end 132 that can include an integrated heel tip 134 or a heel tip 134 that is attached to the widened distal end 135 to form the heel end 132. The widened distal end 135 can have a width $HW_1$ range of cross sectional widths of between about 0.8 inches to about 1.25 inches and in one embodiment is about 0.89 inches, in a second embodiment is about 1.0 inches.

Figure 6F:
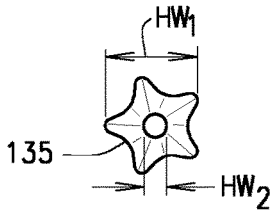
Figure 6E:
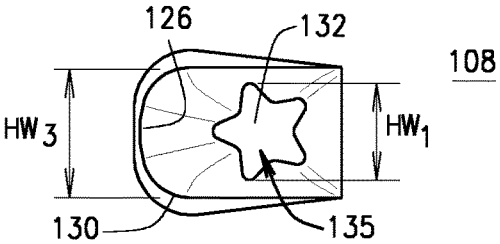

FIG. 6F is a cross-section top down view along sectional line X-X of FIG. 6B showing one illustration of the comparative width $HW_2$ of the heel relative to the $HW_1$ width of the distal end 135. In this illustration, the distal end 135 has a star shape, but as addressed above, the distal end 135 can have other suitable shapes.

Figure 7A:
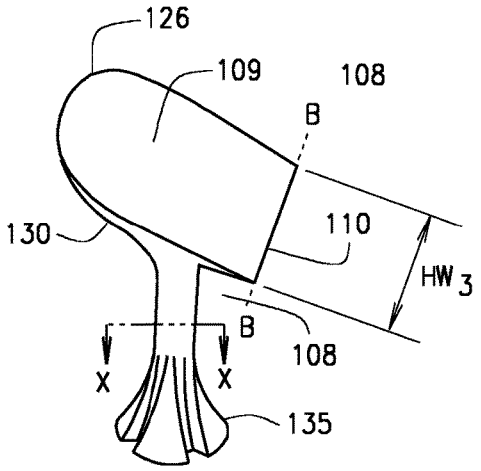
FIGS. 7A-7F are illustrations of a heel for a women's shoe having a widened flower petal-shaped heel tip according to some exemplary embodiments.
Figure 7B:
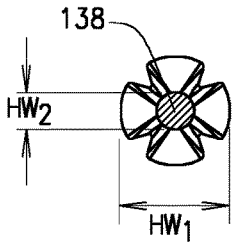
Figure 7C:
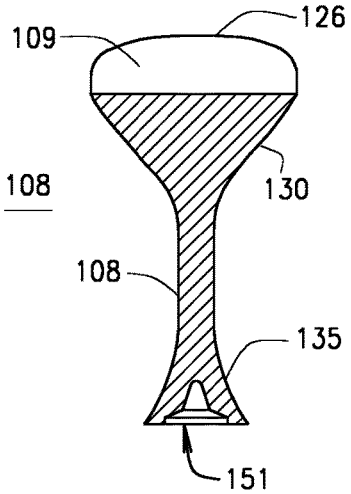
Figure 7D:
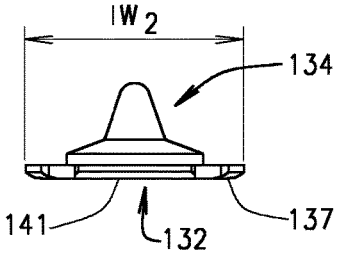
Figure 7E:
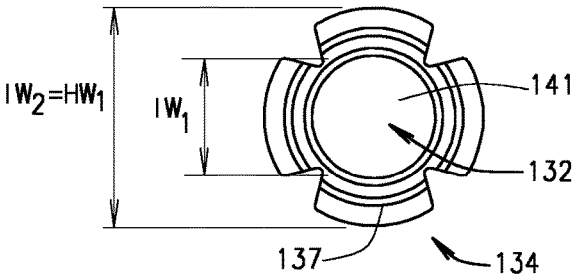
Figure 7F:
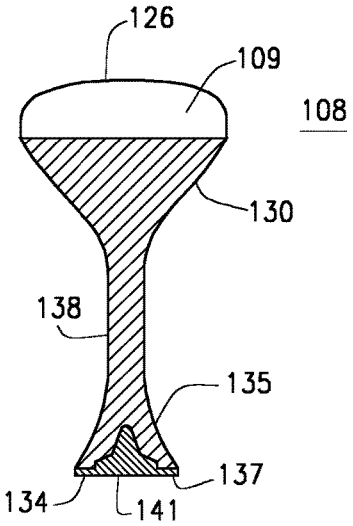

FIGS. 7A-7F provide views of another embodiment of the heel 108. FIG. 7B is a similar top down cross section view along sectional line X-X. FIG. 7C shows an embodiment having the distal end 135 including a center cavity 151 for receiving a mating heel tip 134. An insert heel tip 134 for the cavity 151 is illustrated in FIG. 7D. As shown, the heel tip 134 defines the distal heel end 132 which can include anti-skid features. Further, as shown the heel tip 134 can include an outer portion 137 and an inner portion 141 wherein the inner portion is inserted into the cavity 151 and the outer portion 137 extend to cover the remaining end of the distal end 135. The heel tip insert 134 can include a center portion 137 with a width of $IW_1$ that corresponds to the width of the cavity 151 and an outer width $IW_2$ that corresponds to the width of the distal end $HW_1$. FIG. 7F illustrates the heel tip insert 134 positioned in the cavity 151 wherein the heel tip 134 forms the distal heel end 132 with the outer portion 137 and the inner portion 141. The outer portion 137 and the inner portion 141 of the heel tip insert 134 can be composed of the same material or a different material. The inner portion 141, the outer portion 137 or their combination can be formed to have a shape that is creative, stylish, distinctive, or that acts as a trademark, while providing an improved traction and larger surface area to prevent slippage of the heal and the insertion and catching of the heel in holes, slots or crevices of the walking surface.

Figure 8:
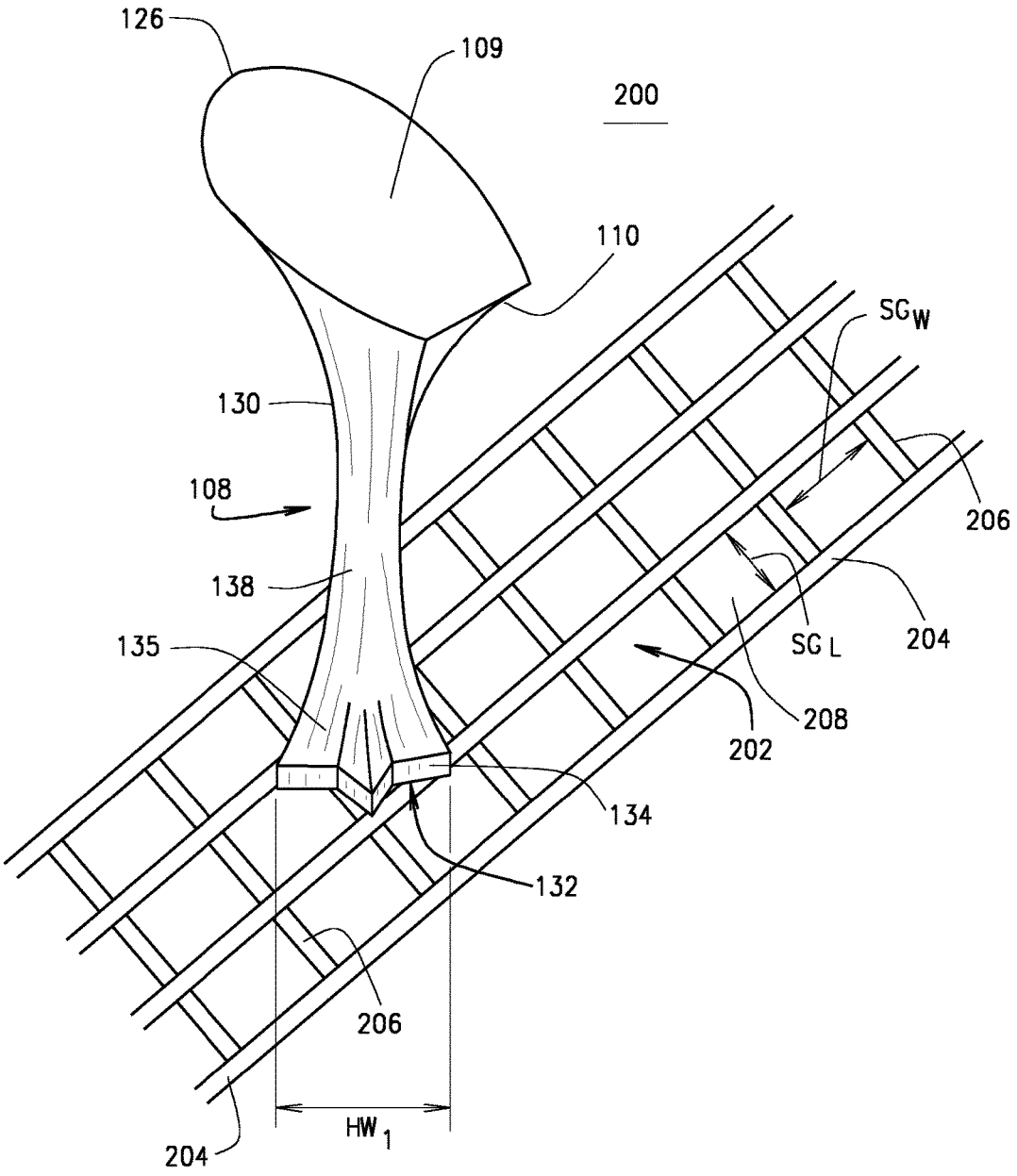
FIG. 8 is an isometric view of a heel according to some embodiments on a perforated/grated walking surface.

FIG. 8 illustrates a heel 108 as described above on a common walking surface having a metal grate 202 such as is often used in sidewalks. The metal grate 202 includes beams 204 and laterals 204 that form holes 208. These grate holes 208 typically have a surface grate width $SG_W$ and a surface grate length $SG_L$. The distal end 135 of the heel 108 includes the heel tip 134 and the heel tip end 134 that has a minimal heel width $HW_1$ that is greater than the width $SG_W$ and/or length $SG_L$ of the common grate 202. As such, a wearer of the shoe 100 with the widened heel 108 as described herein will not have the heel end 135 get caught or stuck in any of the grate holes 208. However, the heel 108 will still have a stylish narrowed shank that is desired by wearers of high heel shoes. The sole insert 112 and the heel tip 132 can also be formed of a non-slip or non-skid material that reduces slippage of the shoe 100 on slippery or wet walking surfaces such as a wet grate 202.

The heel 108 of the footwear is designed so that it holds up against normal wear and tear more so than traditional high heels. The heel shape starts out wide, thins through the middle shank portion for stylistic and proportion purposes, and then gets wide again at the distal end 135 where the heel touches the ground, which provides more support for the wearer at the heel 108 of the footwear. In some embodiments, a rubber tread piece can be affixed to the bottom of the heel end 134, similar to that of a tire, for anti-slip utility and traction with each step. The shape and size of the heel end 134 and/or the distal end 135 is such that the heel doesn't slip into and get stuck in grates, cracks, holes, or other types of breaks, which gives added security and stability for the wearer with each step.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. A women's high heel shoe comprising:

a vamp for enclosing at least a portion of a foot of the wearer of the shoe;

a shoe sole having a front, a middle and a back, the sole having a sole base having an exposed sidewall defining an outer perimeter of the shoe sole and being coupled to at least a portion of the vamp for support the vamp, the sole base having an inner sole base comprised of an inner sole base material and an outer sole base material that is a leather material, the front sole base positioned beneath the front of the foot and toes of the wearer and the back sole positioned for supporting a heel of the foot of the wearer, the sole including a non-skid contact component positioned within the perimeter of the front of the outer sole base and beneath a ball of the wearer's foot, the non-skid contact component being composed of an anti-skid material that is a different material than the material of the sole base;

the heel of the shoe having a heel monolithic elongated main body defining the high heel shoe with a heel height of between about 2 inches and about 5 inches and having a proximal end defining an upper attachment portion, a heel distal end, and a heel shank having a solid body that is defined there between;

the proximal end configured for attachment to a heel portion of a shoe sole base and having a wide dimension corresponding to an outer periphery thereof;

the heel shank having a narrowed neck portion with an outer dimension between 0.25 and 0.40 inches and having a heel shank shape that is substantially circular;

the distal end of the heel having an outer periphery defining a distal end shape that is different than the heel shank shape and that increases in its outer dimension from the heel shank downwardly to a lower end of the distal end, the outer dimension of the lower end of the distal end having an outer lateral and longitudinal dimension between about 0.9 and about 1.25 inches and being comparatively greater than the outer dimension of the heel shank; and a heel tip coupled to the lower end of the distal end and having a heel tip shape that matches the distal end shape, the heel tip having a surface contact portion composed of a non-skid material.

2. The shoe heel of claim 1 wherein the distal end shape and the heel tip shape are a shape selected from the group consisting of a polygon, a regular convex polygon, an equiangular polygon, a star, a flower, each with regular non-rounded or rounded corners.

3. The shoe heel of claim 1 wherein the heel shank has a narrowed neck portion with an outer dimension is about 0.3 to about 0.36 inches and the distal end has an outer dimension that is about 1.0 inch.

4. The shoe of claim 1 wherein the material of the non-skid contact component is a polymer or a rubber.

5. The shoe of claim 4 wherein the non-skid contact component is dimensioned and positioned inward from the perimeter of the sole base and beneath the ball of the wearer's foot so as to not be visible from a side or front of the shoe when the front sole base is in contact with a walking surface.

6. The shoe of claim 1 wherein the front outer sole base defines a cavity within the perimeter of outer sole base and beneath the ball of the wearer's foot, and wherein the non-skid contact component is an insert positioned in the cavity.

7. The shoe of claim 6 wherein the non-skid contact component is dimensioned and positioned inward from the perimeter of the from front sole base and beneath the ball of the wearer's foot so as to not be visible from a side or front of the shoe when the front sole base is in contact with a walking surface.

8. The shoe of claim 6 wherein the cavity in the outer sole base is shaped and dimensioned to substantially conform to a shape of the front sole base, the cavity having a cavity perimeter that is set back from the perimeter of the from front sole base defining an outsole between the outer sole base perimeter and the cavity perimeter there between, the cavity forming a raised cavity wall in the front outer sole base; and the insert positioned and fixedly coupled in the cavity, the insert having an insert shape defined by a periphery that is substantially the same as the shape of the cavity, the insert having an outer edge, a top surface and a bottom surface, the bottom surface including one or more anti-skid features thereon.

9. The shoe of claim 8 wherein the raised cavity wall includes a groove formed therein, and the insert includes a protrusion about at least a portion of a periphery dimensioned for mating with the groove in the raised cavity wall of the outer sole base, the insert being coupled at least in part to the sole base by placement of the protrusion of the insert into the corresponding groove of the raised cavity wall and by an adhesive.

10. The shoe of claim 6 wherein the cavity is not a through cavity in the outer sole base.

11. The shoe of claim 1 wherein the non-skid contact component further includes one or more anti-skid bottom contact features on a bottom providing increased friction between the non-skid component and a walking surface.

12. A women's high heel shoe comprising:

a shoe sole base having a front, a middle and a back and a top surface and a bottom surface, the sole base includes a lower sole positioned at the front for supporting a ball and toes of a wearer of the high heel shoe with an upper sole positioned at the back for supporting the heel of the wearer and for supporting a heel of the shoe, and a shank sole defined in the middle between the lower sole and the upper sole, the shoe sole base having an outer shoe sole base having an outer perimeter defining a shape of the sole base and an exposed sidewall thereof, the outer shoe sole base being composed of a sole base material that is a leather material;

a non-skid contact component positioned within the perimeter of the front of the sole base and beneath a ball of the wearer's foot, the non-skid contact component being composed of an anti-skid material that is different than the sole base material; and a heel main elongated body defining the high heel shoe with a heel height of between about 2 inches and about 5 inches and having a heel monolithic main body having a proximal end defining an upper attachment portion, a heel distal end and a heel shank having a solid body that is defined there between that is substantially circular;

having a proximal end defining an upper attachment portion, a heel distal end and a heel shank defined there between, the proximal end configured for attachment to the upper sole of the base and having a wide dimension corresponding to an outer periphery thereof, the distal end having an outer periphery defining a distal end shape that increases in its outer dimension from the heel shank downwardly to a lower end of the distal heel end having an outer lateral and longitudinal dimension between about 0.9 and about 1.25 inches and the heel shank having a narrowed neck portion with a heel shank shape that is different than the distal end shape and that has an outer dimension being comparatively less than the outer dimension of the lower end of the distal end and being between 0.25 and 0.40 inches; and a heel tip coupled to the distal end and having a heel tip shape that matches the distal end shape, the heel tip having a surface contact portion composed of a non-skid material.

13. The shoe of claim 12 wherein the heel shank has a narrowed neck portion with an outer dimension is about 0.3 to about 0.36 inches and the lower end of the distal end of the heel has an outer dimension that is about 1.0 inch.

14. The shoe of claim 12 wherein the distal end shape and the heel tip shape are selected from the group consisting of a polygon, a regular convex polygon, an equiangular polygon, a star, a flower, each with regular non-rounded or rounded corners.

15. The shoe of claim 12 wherein the material of the non-skid contact component is a polymer or a rubber.

16. The shoe of claim 15 wherein the non-skid contact component is dimensioned and positioned inward from the outer perimeter of the sole base and beneath the ball of the wearer's foot so as to not be visible from a side or front of the shoe when the front sole base is in contact with a walking surface.

17. The shoe of claim 12 wherein the front outer sole base defines a cavity within the perimeter of sole base and beneath the ball of the wearer's foot, and wherein the non-skid contact component is an insert positioned in the cavity.

18. The shoe of claim 17 wherein the non-skid contact component is dimensioned and positioned inward from the perimeter of the front sole base and beneath the ball of the wearer's foot so as to not be visible from a side or front of the shoe when the front sole base is in contact with a walking surface.

19. The shoe of claim 17 wherein the cavity in the outer sole base is shaped and dimensioned to substantially conforms to a shape of the front sole base, the cavity having a cavity perimeter that is set back from the perimeter of the from front sole base defining an outsole between the outer sole base perimeter and the cavity perimeter there between, the cavity forming a raised cavity wall in the front outer sole base; and the insert positioned and fixedly coupled in the cavity, the insert having an insert shape defined by a periphery that is substantially the same as the shape of the cavity, the insert having an outer edge, a top surface and a bottom surface, the bottom surface including one or more anti-skid features thereon.

20. The shoe of claim 17 wherein the raised cavity wall includes a groove formed therein, and the insert includes a protrusion about at least a portion of a periphery dimensioned for mating with the groove in the raised cavity wall of the outer sole base, the insert being coupled at least in part to the sole base by placement of the protrusion of the insert into the corresponding groove of the raised cavity wall and by an adhesive.

21. The shoe of claim 17 wherein the cavity is not a through cavity in the outer sole base.

22. The shoe of claim 12 wherein the non-skid contact component further includes one or more anti-skid bottom contact features on a bottom providing increased friction between the non-skid component and a walking surface.

* * * * *